United States Patent [19]

Mirto

[11] Patent Number: 4,550,943

[45] Date of Patent: Nov. 5, 1985

[54] SNOW REMOVER FOR AUTOMOBILES AND THE LIKE

[76] Inventor: Nicholas Mirto, 29 Cambridge Ave., Staten Island, N.Y. 10314

[21] Appl. No.: 633,517

[22] Filed: Jul. 23, 1984

[51] Int. Cl.[4] ..... E01H 5/02

[52] U.S. Cl. ..... 294/54.5; 294/50.8; 294/53.5

[58] Field of Search ..... 294/54.5, 53.5, 49, 294/51, 52, 56, 57, 58, 50.8; 15/144 A; 37/53; 56/400.04, 400.18, 40.19; 172/372; 403/57, 58, 74

[56] References Cited

U.S. PATENT DOCUMENTS 4,054,313 10/1977 Ciuci ..... 294/53.5

4,264,095 4/1981 Lemasters ..... 294/53.5

*Primary Examiner*—James B. Marbert

*Attorney, Agent, or Firm*—Richard L. Miller

[57] ABSTRACT

A snow remover for automobiles and the like in which a novel structure for a fold-over handle is provided. The handle then telescopes for compact carrying. Spring loaded snap locks are provided to keep the handle rigid during use. A wingnut and threaded bolt are used to keep the invention rigid when the handle is unfolded. The rubber scraping blade is easily replaced.

8 Claims, 5 Drawing Figures

SNOW REMOVER FOR AUTOMOBILES AND THE LIKE

BACKGROUND OF THE INVENTION

The present invention relates generally to the field of automotive accessories, and, more specifically, to portable, collapsible devices which may be used to remove accumulated snow from the windshield or body of a car.

At the present state of the art automobile snow removers either have very short handles, and therefore are difficult to use, or, they have very long handles and are, therefore, difficult to store.

SUMMARY OF THE INVENTION

It is, therefore, a primary object of the present invention to provide a snow remover for automobiles and the like in which the handle is collapsible by virtue of its telescoping construction.

Another object is to provide a snow remover for automobiles and the like in which the handle folds to the side once the handle has been collapsed.

A further object is to provide a snow remover for automobiles and the like which is rigid and stable when unfolded and extended.

A yet further object is to provide a snow remover for automobiles and the like which is simple and inexpensive to fabricate.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
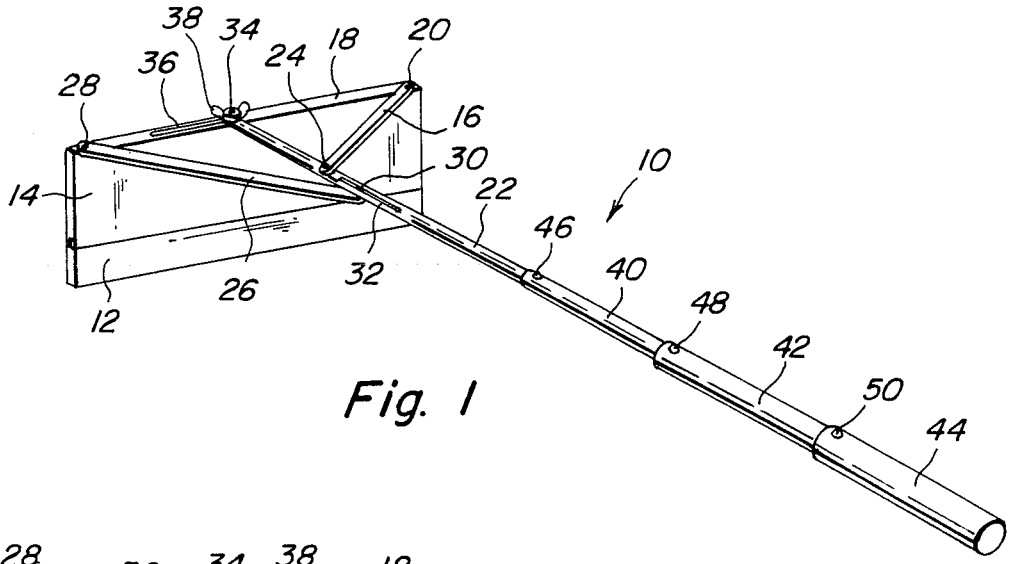
FIG. 1 is a perspective view of the invention open and ready for use.
Figure 2:
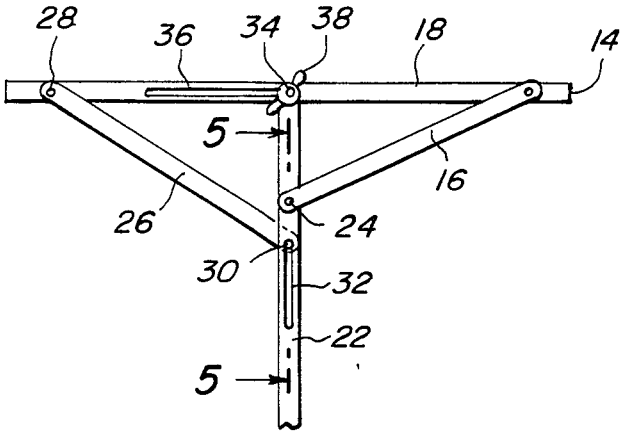
FIG. 2 is a partial top view thereof.
Figure 3:
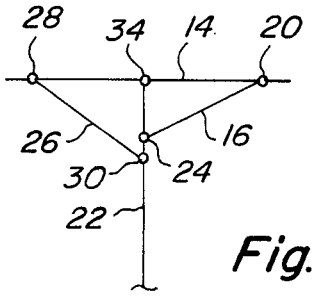
FIG. 3 is a partial diagrammatic top view of the invention in an open position as illustrated in FIG. 2.
Figure 4:
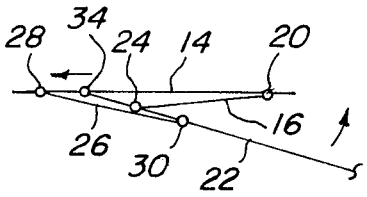
FIG. 4 is a partial diagrammatic top view of the invention in an almost completely folded position.
Figure 5:
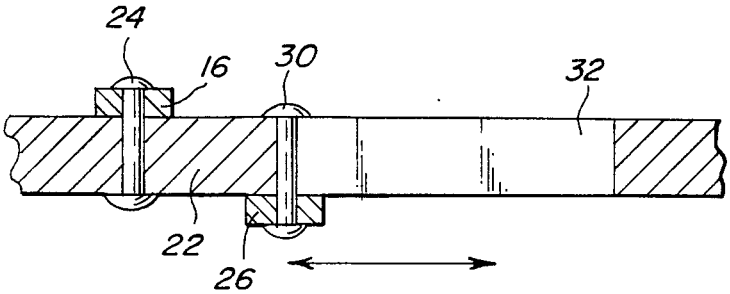
FIG. 5 is a partial enlarged cross sectional view taken along line 5—5 in FIG. 2 illustrating further constructional details.

As may be seen in FIG. 1, the invention 10 contains a rubber scraper 12 attached to a rigid base 14 which may, typically, be made of wood, plastic or metal. Rigid base 14 may be provided with a channel so that replacement rubber scrappers may inserted.

The way in which the handle folds over may best be understood with reference to FIGS. 2, 3, 4, and 5. A pivoting bar 16 is attached to the top surface 18 of rigid base 14 by a rivet 20. The other end of pivoting bar 16 is attached to telescoping section 22 by a rivet 24. A sliding bar 26 is attached to the other end of top surface 18 by a rivet 28 and another rivet 30 passes through the opposite end of sliding bar 26 and into slot 32 in telescoping section 22. A threaded bolt 34 slides along slot 36 in top surface 18, passes through an opening in one end of telescoping section 22 and is secured in place by wingnut 38. The invention 10, is shown fully extended in diagrammatic FIG. 3. When a folding force is applied in the direction of the arrow in FIG. 4, telescoping section 22 folds over until it is near parallel to top surface 18. Although particular fastening means have been shown, they are typical only, and other fastener types could readily be employed without departing from the spirit of the invention.

The telescoping handle, as illustrated in FIG. 1, consists of four telescoping sections 22, 40, 42 and 44. Section 44 may be covered with resilient padding for ease of use. Spring locks are provided at 46, 48 and 50 which snap through holes in telescoping sections 40, 42 and 44 respectively.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A snow remover for automobiles and the like, comprising in combination:

(a) a rectangular solid one piece rigid base to which is attached a rubber scraper;

(b) a pivoting bar pivoted by a fastener to one end of the top surface of said rigid solid base the other end of which is pivoted by a fastener to one place at the end of a collapsible handle;

(c) a sliding bar one end of which is pivoted to the opposite end of said top surface of said rigid solid base from said pivoted bar, the other end of which is slidably connected by a fastener to a lengthwise slot in said collapsible handle; and, (d) a collapsible handle one end of which is slidably connected by a fastener to a lengthwise slot on said top surface of said rigid solid base; whereby when said collapsible handle is displaced in a direction away from said lengthwise slot on said top surface of said rigid solid base said collapsible handle folds against said rigid solid base.

2. Snow remover for automobiles and the like, as recited in Claim 1, wherein said collapsible handle comprises a plurality of telescoping sections.

3. Snow remover for automobiles and the like, as recited in claim 2, wherein the largest diameter section of said telescoping handle is padded for easier use.

4. Snow remover for automobiles and the like, as recited in claim 1, wherein said fasteners are rivets.

5. Snow remover for automobiles and the like, as recited in claim 1, wherein said fasteners are threaded bolts and wing nuts.

6. Snow remover for automobiles and the like, as recited in claim 1, wherein said fasteners are a combination of rivets and threaded bolts and wing nuts.

7. Snow remover for automobiles and the like, as recited in claim 1, wherein said fastener which is used in said lengthwise slot in the top surface of said rigid base is a threaded bolt with wing nut and all other fasteners are rivets.

8. Snow remover for automobiles and the like, as recited in claim 2, further comprising a collapsible handle with spring loaded snap locks which lock each telescoping section into place when fully extended and are unlocked by depressing said spring loaded snap locks one at a time and collapsing said telescoping sections.

* * * * *